US008066270B2

(12) United States Patent
Siegel

(10) Patent No.: US 8,066,270 B2
(45) Date of Patent: Nov. 29, 2011

(54) FLEXIBLE JAW VISE ACCESSORY FOR IRREGULAR OBJECTS

(76) Inventor: Robert P Siegel, Rochester, NY (US)

( * ) Notice: Subject to any disclaimer, the term of this patent is extended or adjusted under 35 U.S.C. 154(b) by 961 days.

(21) Appl. No.: 12/069,792

(22) Filed: Feb. 12, 2008

(65) Prior Publication Data

US 2008/0217831 A1 Sep. 11, 2008

Related U.S. Application Data

(63) Continuation-in-part of application No. 11/225,773, filed on Sep. 13, 2005, now abandoned.

(60) Provisional application No. 60/609,794, filed on Sep. 15, 2004.

(51) Int. Cl.
*B25B 1/00* (2006.01)

(52) U.S. Cl. ..... 269/279; 269/272; 269/282; 269/43; 269/45

(58) Field of Classification Search ..... 269/279, 269/272, 282, 283, 251, 266, 43, 45
See application file for complete search history.

(56) References Cited

U.S. PATENT DOCUMENTS

| | | | | | |
|---|---|---|---|---|---|
| 999,978 | A * | 8/1911 | Fisher | 269/210 |
| 1,274,554 | A * | 8/1918 | Ives | 254/104 |
| 2,526,020 | A * | 10/1950 | Fuhr | 269/248 |
| 2,741,145 | A * | 4/1956 | Bahorik | 269/208 |
| 2,754,708 | A * | 7/1956 | Peterson | 269/224 |
| 4,449,704 | A * | 5/1984 | Goulter | 269/88 |
| D292,481 | S * | 10/1987 | Wolff | D8/74 |
| 6,244,581 | B1 * | 6/2001 | Arnhold | 269/43 |
| 7,290,761 | B2 * | 11/2007 | Siegel | 269/266 |
| 2006/0055098 | A1 * | 3/2006 | Siegel | 269/279 |

* cited by examiner

*Primary Examiner* — George Nguyen

(57) ABSTRACT

A vise jaw accessory that attaches to a conventional vise having a unique means of mounting above the vise, using a set of accessory jaw brackets, front and rear, with special mounting provisions for each, capable of supporting and positioning a set of accessory jaws that hold and stabilize a wide variety of irregularly shaped objects by means of opposing arrays of spring-loaded pins capable of individual deflection. The jaws are designed to be interchangeable to accommodate work types ranging from delicate to heavy-duty, as well as flat faces or other jaw face types.

5 Claims, 5 Drawing Sheets

63
40
37
42
66
62
61
64
43
45
44
30
33
38
32
47
49
48
39

61
61
51
54
50

63
55

52

23
20
21
22
24
23

26
22
20

18

FLEXIBLE JAW VISE ACCESSORY FOR IRREGULAR OBJECTS

This disclosure is a continuation-in-part of provisional patent number US60/609,794 filed Sep. 15, 2004 and of application Ser. No. 11/225,773 filed on Sep. 13, 2005 now abandoned by the same inventor.

BACKGROUND OF THE INVENTION

1. Field of the Invention

This disclosure relates generally to vises and, in particular, to an apparatus that extends the utility of a conventional vise by allowing a set of accessory jaws to be attached that are designed to grasp irregularly shaped objects.

2. Background

Woodworking vises and machinist vises are very common and useful tools. Generally, they are limited to applications entailing work objects with two parallel sides. Certain specialized jaws are available, such as, notched jaws for holding pipes, or rubber jaws, but for the most part, specialized holding jigs must be built in order to hold irregular objects, which can take considerable time and expense. This device was invented to address this shortfall, which is to say, providing a vise accessory attachment system, compatible with a conventional vise, that includes accessory jaws capable of gripping a wide range of irregular objects.

A wide variety of specialized holding and clamping devices have been developed in an attempt to accommodate irregularly shaped objects. Examples of such devices are found in U.S. Pat. Nos. 5,460,064, 5,806,385, 6,098,507, 6,092,443, and 6,138,534. While these and other devices represent improvements in the art of holding irregularly shaped objects, they suffer from several drawbacks that have prevented widespread application in the machining arts.

U.S. Pat. No. 626,427 to E. H. Jones, issued Jun. 6, 1899 is directed to a vise in which an article is placed between two jaws provided with adjustable projections (or between a single jaw and a plane jaw) and the jaws are moved together, so that the article displaces the projections opposite to it and their ends bear on the different portions of its form and hold it up approximately as a mold would do. The projections are then clamped securely in the projections to which they have adjusted themselves and the jaw is tightened upon the article by a vise screw.

U.S. Pat. No. 1,499,989 to F. Lehmann, issued Jul. 1, 1924 discloses a vise for use with machine tools that includes a base plate adapted to be secured to the sliding carriage of a planing machine, or the like, and having two housings mounted oppositely on the base plate. The two housings are adapted such that at least one will slide toward the other and a series of spring controlled clamping jaws are so arranged in each of the housings that projecting parts of the work piece causes part of the jaws to be pressed back into the housings until all of the spring controlled jaws are in contact with and firmly grip the work piece on all sides.

U.S. Pat. No. 2,754,708 to C. R. Peterson, issued Jul. 17, 1956 shows a vise for handling irregular shaped object that includes a base having a stationary jaw projecting upwardly from one end and a movable jaw slidable on the base. Included in each of the jaws is a hollow block having facing openings with a plurality of movable work engaging members slidably carried in the block. A movable pressure plate in each block adjacent one side wall thereof is clampable against the work engaging members to lock each of them into work engaging position. Springs are used to urge each work-engaging member into working position.

U.S. Pat. No. 4,752,063 to Bela Nagy, issued Jun. 21, 1988 is directed to a vise attachment for use on a vise assembly for holding objects having irregularly shaped surfaces and includes a small compact housing having a plurality of blade elements disposed adjacent to each other and slidably mounted within a rectangular opening on one side of the housing and movable between and extended position and a retracted position. Each element preferably comprises a plate member having smooth planar surfaces and a concave curved back edge and stop means disposed on upper and lower edges for setting a limit for extension of the blade from the housing. A self-distributing non-resilient medium is positioned within the housing and has a predetermined volume for filing the housing when the blades are in a retracted position. A distribution and reset means causes the blades to reposition themselves to extend fully through the rectangular opening when not holding an object.

U.S. Pat. No. 6,032,940 to Ingo E. Wolfe, issued Mar. 7, 2000 discloses a universal vise that has a movable and a fixed jaw that can be indexed at 90° increments to provide for four separate work clamping surfaces on each jaw. The vise includes a vise screw driving a nut that drives the movable jaw in each of four indexed positions of the movable jaw. The indexable jaws permit the vise to be adapted to hold four different types of work pieces.

U.S. Pat. No. 6,783,123 to Guimont describes a vise jaw assembly consisting of blocks containing an arrangement of apertures containing pins that can be independently deployed. by means of a fluid. The pins serve as a configurable step to support the bottom of the work piece above the deck.

U.S. Pat. No. 4,422,629 to Carlson describes an accessory apparatus for vises that utilizes a pair of accessory members. The accessory apparatus as described, provides three ranges of gripping areas based on the Z-shaped cross-section of the mating members.

U.S. Pat. No. 6,427,995 to Steinwall describes a vise with quick change jaw system. The jaw faces are secured to the vise body by means of locking pins.

U.S. Pat. No. 6,196,536 to Hintze describes a grip set attachment to a conventional consisting of a master grip and a series of additional grips to allow the user to work on all sides of work piece held by the grips.

U.S. Pat. No. 2,741,145 to Bahorik describes a two-part vise jaw accessory that clamps onto the fixed and movable jaw portion of a vise for the purpose of providing an extended jaw capacity that allows the vise to hold larger objects than the basic vise otherwise would provided that the objects have at least two parallel sides.

U.S. Pat. No. D292,481 to Wolff describes an ornamental design for vise extender jaws that attach to threaded holes in the fixed and movable jaws of a conventional vise with fixed length pins that rests on the vise jaws for support for the purpose of providing additional linear capacity for work pieces with parallel sides.

U.S. Pat. No. 6,953,188 by this inventor describes a vise utilizing jaws containing arrays of spring-loaded pins for grasping irregularly shaped objects. This is an unconventional vise which closes by the combination of a linear ratchet bar and a rotary power cam.

U.S. Pat. No. 7,290,761 also by this inventor offers an improvement to the above-mentioned vise in that it provides the ability the remove the base and thus alternatively use the vise as a clamp, the means to turn the vise on its side in a configuration that enables it to be used in a drill press, and an outrigger feature that will keep the vise from tipping when used upright with large work objects.

These last two vises answers most of the shortcomings of the other vises described above in that they provide a convenient method of grasping irregular work pieces in a highly versatile vise configuration, albeit in a somewhat unconventional manner that uses a linear ratchet bar and power cam as opposed to the traditional power screw. However, since many people already own conventional vises and may be reluctant to invest in an additional vise solely for the purpose of grasping irregular objects, there is a need for a vise accessory that can be added to a traditional vise and provide the added functionality of being able to firmly and securely grasp irregularly shaped objects.

Accordingly, a device is disclosed that answers this need consisting of two accessory jaw face brackets that attach to the vise jaw faces by means of mounting screws deployed through a universal mounting pattern. (At least 95% of all commercial vises utilize one of three typical hole-spacing patterns.) The front jaw accessory bracket is further supported by means of an adjustable wedge inserted between the jaw head and the bracket. The rear jaw accessory bracket is supported by means of an adjustable pillar that rests on the vise anvil. The front accessory jaw rigidly attaches to the front jaw face accessory bracket which allows the front accessory jaw to move in unison with the front vise jaw, while allowing for interchangeable jaws with various grasping characteristics. The rear accessory jaw attaches to the rear jaw accessory bracket in a manner which can add adjustability to the relative positioning of the jaws. For example, a ratchet mechanism can be used here to allow relative motion between the rear accessory jaw and the rear accessory jaw bracket, thereby facilitating quick and convenient adjustment of the rear jaw position.

The accessory jaws are designed, with each jaw having upstanding portions to accommodate a variety of interchangeable jaw faces each containing an array of spring loaded pins. The spring-loaded pins enable the vise to grasp objects of highly irregular shapes. These accessory jaws are designed to easily accommodate a variety of such jaw faces with differing force-displacement grasp characteristics, such as, but not limited to light, medium and heavy duty, with respect to their clamping force capability. These characteristics can be controlled by means of such parameters as pin diameter, spring strength and tip type. Various spring-pin excursion lengths can be used to accommodate more different shapes and different spring rate characteristics.

These spring-loaded pin array jaw faces cannot practicably be mounted on the front of conventional jaw faces, for if they were, the capacity of the vise were be substantially reduced and only very small objects could be placed into or secured by the vise. If, for example, a set of these jaw faces with 1.5" length pins were mounted onto the front faces of a vise with a 6" jaw capacity, the effective jaw capacity would be reduced to 3" by the presence of the pins. This necessitates the mounting of the spring-pin array jaw faces above, rather than in front of the traditional jaws.

The foregoing and other features of the exemplary embodiments will be apparent and easily understood from a further reading of the specification, claims and by reference to the accompanying drawings in which like reference numerals refer to like elements and wherein:

Figure 2:
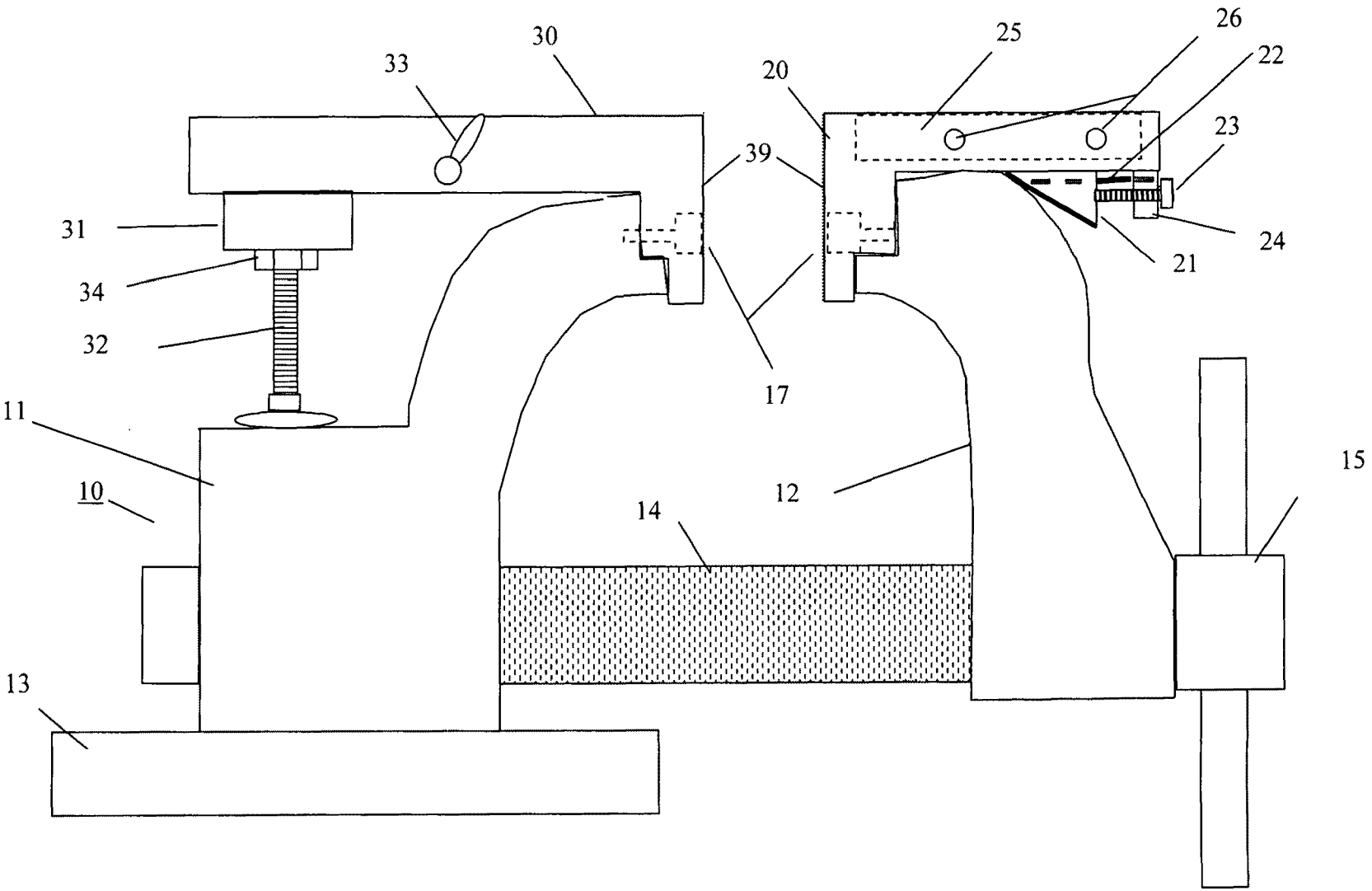
FIG. 2 is a schematic side view of the conventional vise of FIG. 1 showing the front jaw accessory bracket and the rear jaw accessory bracket attached.
Figures 3A, 3B, 3C, 4A, 4B, 4C:
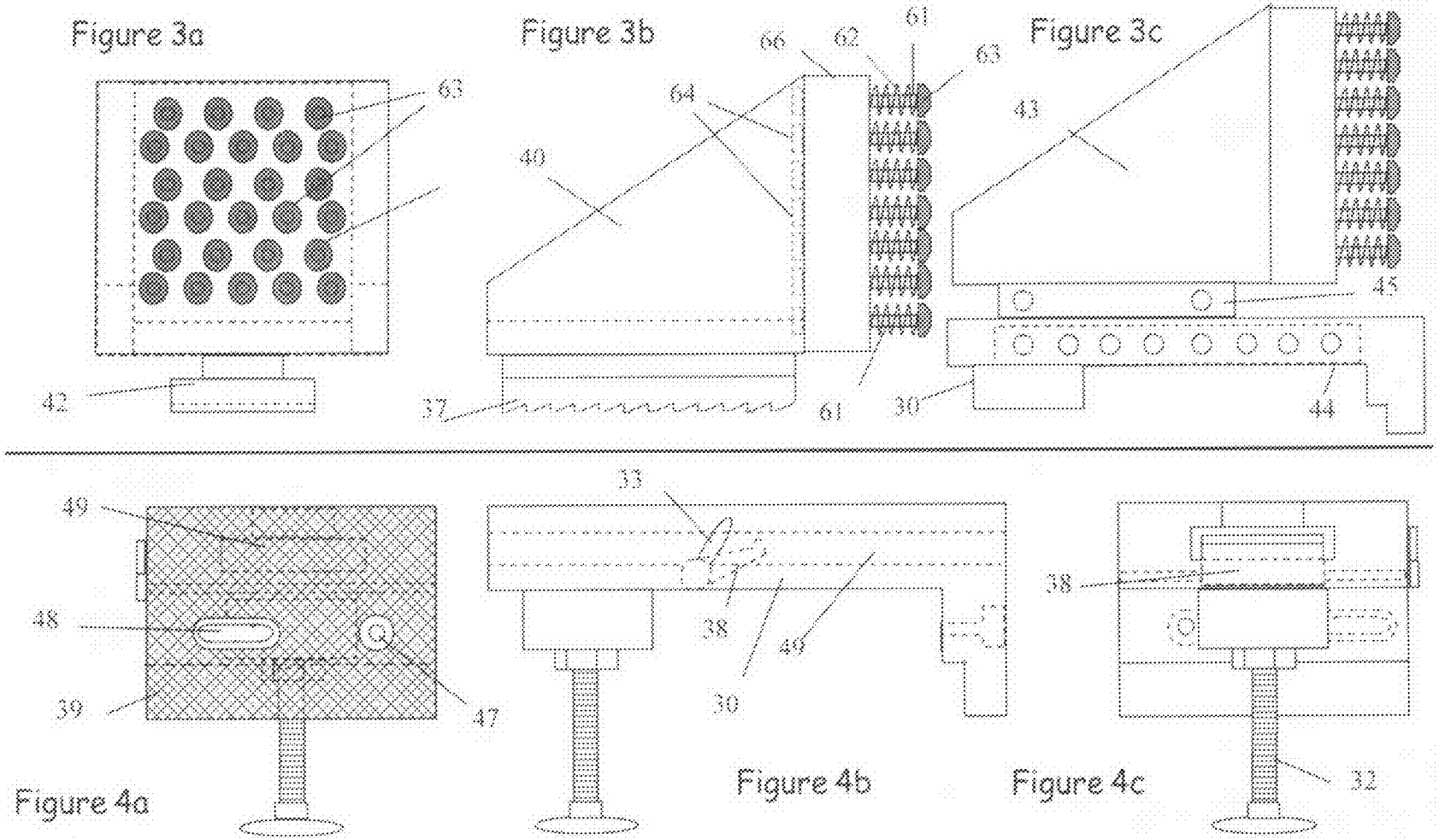
Figures 5A, 5B, 5C, 6A, 6B, 6C:
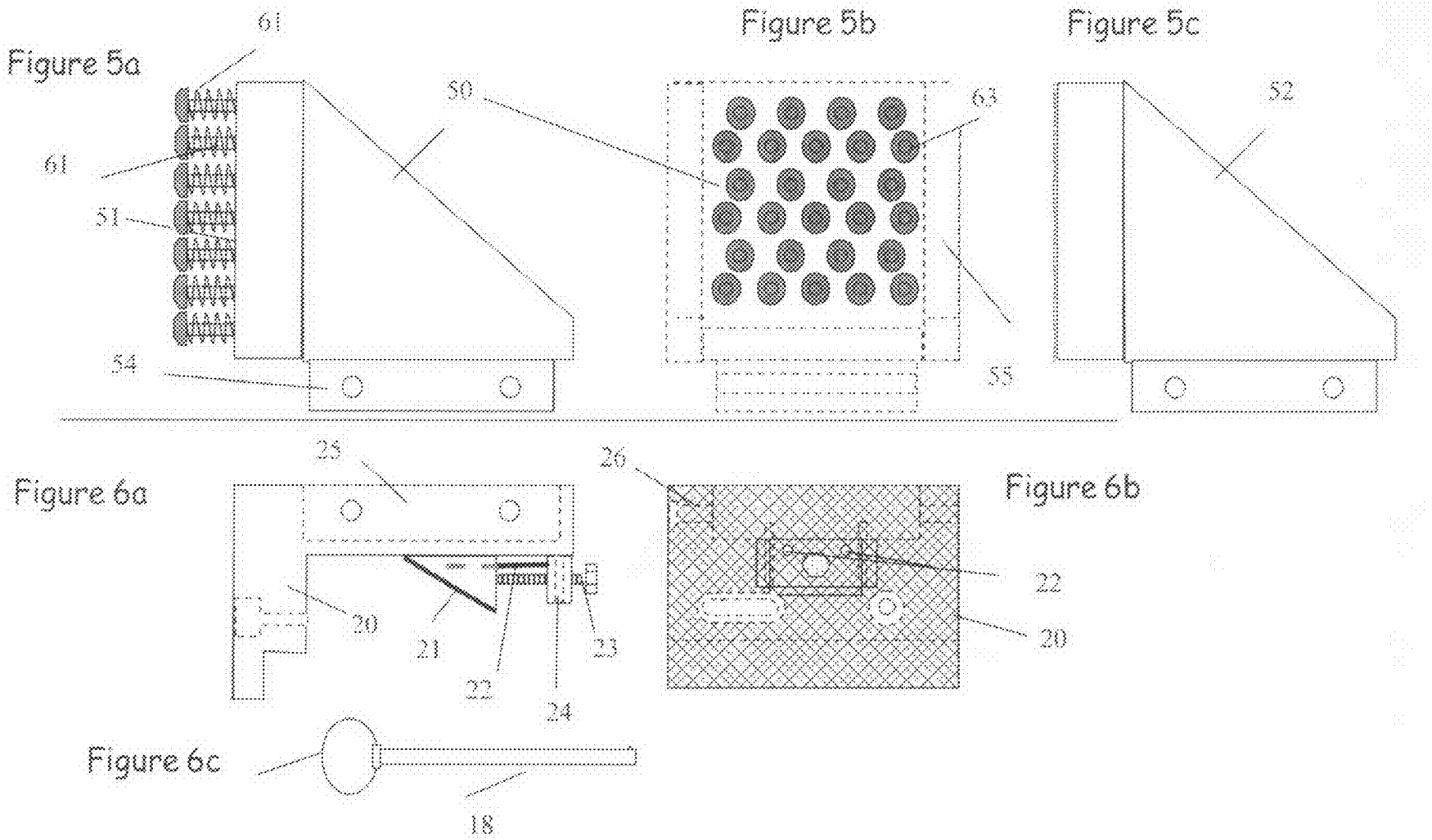

FIGS. 3*a* and 3*b* are views of a rear accessory jaw face;

FIG. 3*c* shows a rear accessory jaw face with an alternative mounting arrangement;

FIGS. 4*a*, 4*b* and 4*c* are front, side and rear views of the linear of the rear jaw accessory bracket shown in FIG. 2;

FIGS. 5*a* and 5*b* and 5*c* are side and front views of a front accessory jaw face;

FIG. 6*a* is a side view detail of the front jaw face bracket;

FIG. 6*b* is a front view detail of the front jaw face bracket

Figure 7:
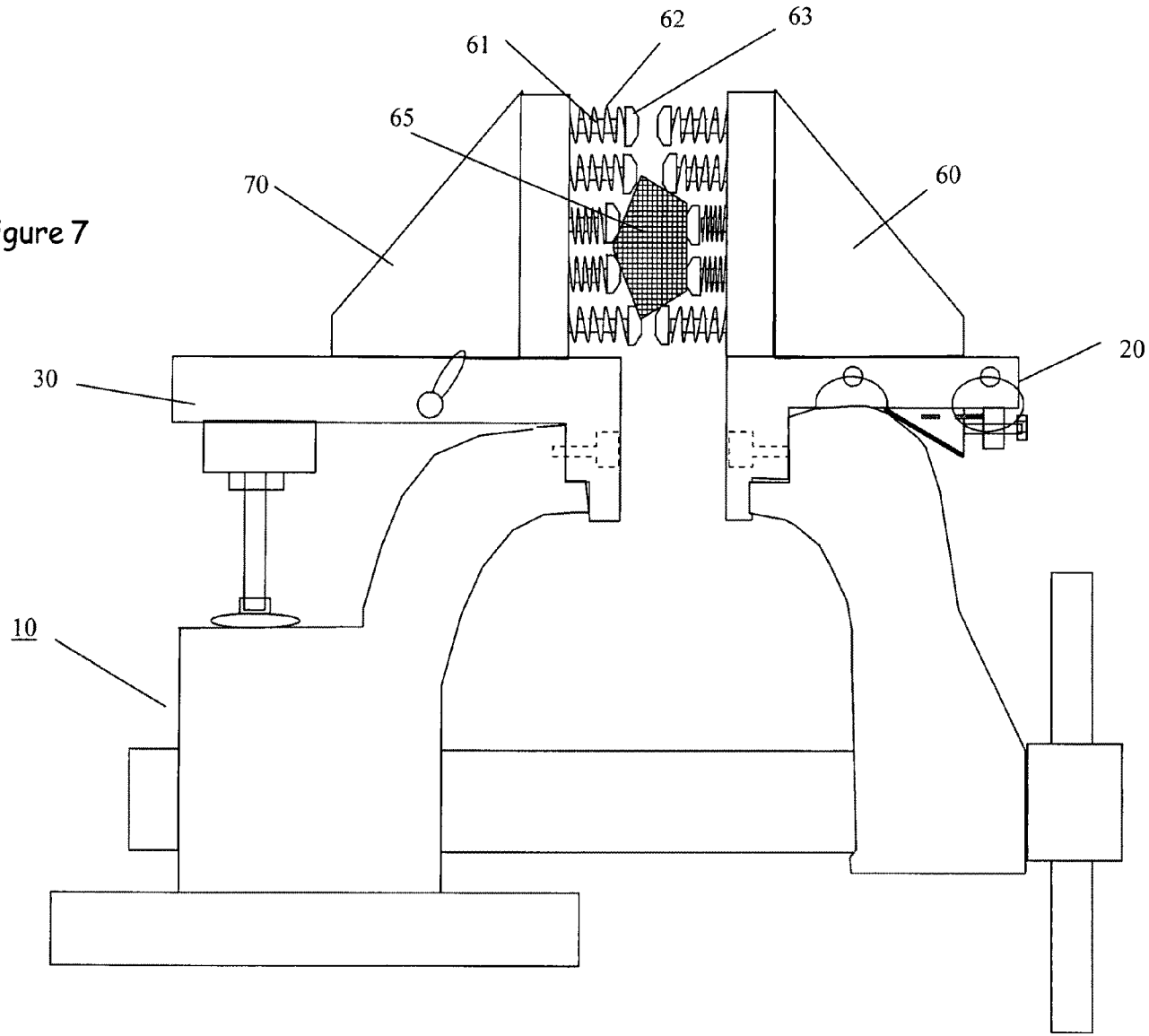

FIG. 6*c* is a side view of a quick release pin used to secure the front accessory jaw to the front jaw accessory bracket;

FIG. 7 is a schematic side view of a conventional vise with front and rear jaw face brackets attached each bearing accessory jaw faces containing an array of spring loaded pins capable of grasping an irregularly shaped object.

DETAILED DESCRIPTION OF THE INVENTION

While preferred embodiments will be described hereinafter, it will be understood that it is not intended to limit the invention to those embodiments. On the contrary, it is intended to cover all alternatives, modifications, and equivalents as may be included within the spirit and scope of the disclosure as defined by the appended claims.

For a general understanding of the features of the exemplary embodiments, reference is made to the drawings. In the drawings, like reference numerals have been used throughout to identify identical elements. FIGS. 1-7 schematically depict various views illustrating an improved vise incorporating the features of the present invention therein. It will become evident from the following discussion that the disclosed vise may be employed in a wide variety of applications for holding irregular objects and is not specifically limited in its application to the particular apparatus and method specifically mentioned herein.

Figure 1:
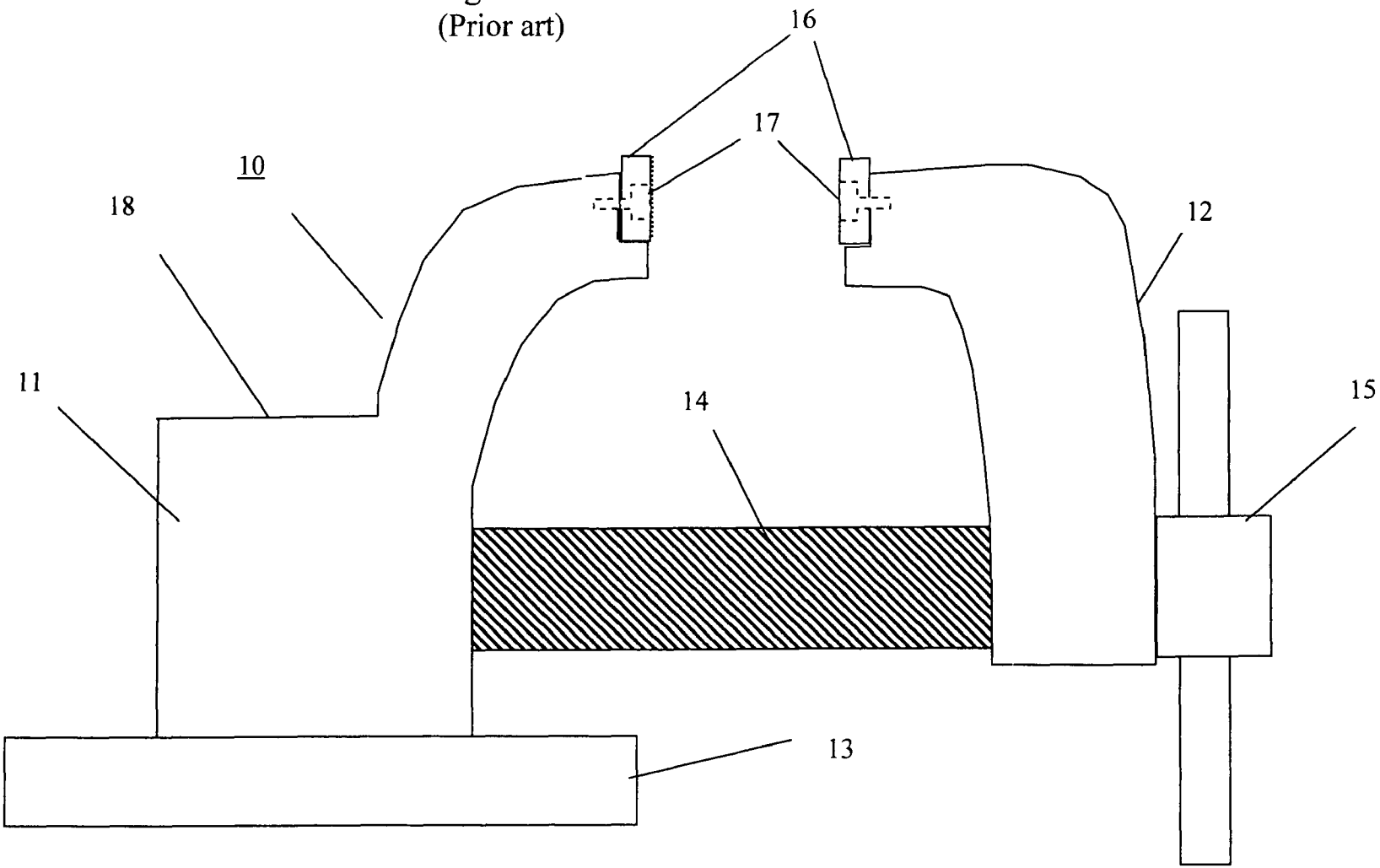
Figure 1 (Prior art)
FIG. 1 is a schematic side view of a conventional vise showing its basic features.

Referring now to FIGS. 1-7, various views are shown illustrating the flexible jaw vise accessory. FIG. 1 shows a conventional vise 10. It consists of a base 13, a stationary jaw 11 with an anvil 18, a movable jaw 12, a drive screw 14, a handle 15, and a set of removable jaw faces 16. The drive screw is used to drive the movable jaw towards the stationary jaw in order to clamp a work piece. Each jaw face generally attaches to its respective jaw by means of a pair of mounting screws 17. The jaw faces are removable so that different surfaces, such as smooth or knurled, or special features, such as notches for small diameter tubing, can be used.

FIG. 2 shows the same conventional vise with the standard jaw faces removed and the accessory jaw brackets attached. The front accessory jaw bracket 20, attaches to the movable front jaw 12 and the rear accessory jaw bracket 30, attaches to the stationary rear jaw 11, both by mounting screws 17. The jaw face brackets have a pattern of mounting holes and slots that allow them to be installed on most standard vises. These jaw face brackets may themselves have jaw face surfaces 39 (e.g. knurled), enabling them to be used as jaws faces when they are not being used to support accessory jaws. This allows the accessory mounting system to be left permanently attached insofar as the brackets themselves can perform the same function for most purposes as the jaw faces they replaced. The front jaw face is further supported in the preferred embodiment by a wedge 21 that is guided by two wedge guide pins 22, and driven into place by a wedge adjusting screw 23 that is held in place by a wedge support block 24. With the wedge firmly lodged between the bottom of the front jaw face bracket and the front jaw, the bracket is sufficiently secured to withstand any additional stress due to a higher point of load application which may have exceeded the holding power of the mounting screws alone.

The front accessory jaw face bracket 20 has an interface that is capable of conveniently and securely attaching to a variety of jaw faces in a stationary manner. This is accommodated by the cutout 25, and the retaining pin holes 26.

The rear jaw face bracket 30 has the capability of attaching a jaw face in a sliding manner which can be used to increase the jaw capacity. The bracket receives additional support from the bracket support bolt 32, which connects to the rear bracket boss 31. Once the bracket is installed with the mounting screws, the support bolt is backed out of the boss until it is in firm contact with the vise anvil. It is then further tightened with a tool to ensure a secure support and held in place with locknut 34. In the preferred embodiment, a ratchet mechanism is used to easily set and release the accessory jaw position, although other mounting schemes can be used. In the preferred mode, the jaw face can be removed entirely by simply depressing the ratchet release lever 33 and sliding the jaw face off. As an alternative, the rear accessory jaw can also be attached to the rear accessory jaw bracket 30 in a manner similar to the front accessory jaw.

FIGS. 3*a* and 3*b* are views of an accessory jaw 40 configured for the rear jaw face bracket 30. This jaw has an array of spring 62 loaded pins 61 of a certain strength and spring constant configured to individually deflect and thereby grasp irregular objects within the force range and tip 63 hardness associated with that jaw face type. The spring-loaded jaws consist of a face plate 66 though which pins 61 pass through. The pins 61 are held in place when in the rest position by the heads 64. The springs 62 are captured on the pins by means of removable tips 63. The rear jaw assembly attaches to the rear bracket in a sliding manner by means of a rail 42 that is configured to ride in a slot in the rear jaw bracket. FIG. 3*b* shows the ratchet teeth 37 that are used in the preferred embodiment to adjustably attach the jaw face assembly to the bracket. FIG. 3*c* shows an optional configuration in which the rear accessory jaw 43 is removably attachable by means of a mounting base 45 to a jaw bracket 44 which is equipped with a series of pin holes. This is a simplified and lower cost arrangement which provides a level of adjustability without the need for a ratchet.

FIGS. 4*a*, 4*b* and 4*c* are several detailed views of the rear accessory jaw bracket 30. FIG. 4*a* shows the front view of the accessory jaw bracket face including the knurled work surface 39. This is to allow the brackets to provide gripping and clamping functionality which is essentially the same as a conventional vise when the accessory jaw faces are removed. This allows the accessory mounting brackets to remain in place even when the accessory jaws are not being used. The mounting hole 47 and slot 48 are provided to allow the bracket to attach to a wide variety of standard hole patterns that are generally available on commercial vises. The inverted t-shaped slot 49 is designed to accommodate the rail 42 as a means of attaching the jaw face to the bracket in a slidable manner. FIG. 4*b* shows the side view which illustrates the ratchet pawl 38 which engages with the ratchet teeth 37. Together these two create a latching action that holds the jaw face assembly in a fixed position after it has been moved to the desired position. The jaw face assembly will stay latched in that position until the ratchet release lever 33 is depressed.

FIGS. 5*a* and 5*b* are side and rear views of the front accessory jaw 50. These views show the array of spring-loaded pins 61,62,63, the mounting base 54 that fits into the cutout 25 and is secured by the quick-release latching pin 18. FIG. 5*b* also shows the side support rails 55 that provide structural strength to the jaw face assembly. FIG. 5*c* shows an alternative accessory jaw 52 with a flat face and a knurled finish to provide additional jaw capacity for objects with two or more parallel sides requiring additional jaw capacity.

FIGS. 6*a* and 6*b* are side and rear views of the front jaw bracket 20. They show the cutout 25, the wedge 21, the wedge support block 24, the adjustment screw 23 and the wedge guide pins 22. FIG. 6*c* shows the quick-release latching pin 18 that attaches the front jaw face assembly 50 to the front jaw face bracket 20.

FIG. 7 shows a vise 10, to which front jaw face bracket 20 and rear jaw face bracket 30 have been attached. In this case, front spring-loaded pin array accessory jaw face 60 and rear spring-loaded pin array accessory jaw face 70 have been attached. These specialized jaw faces are configured with arrays of pins 61, springs 62 and tips 63 in a sliding manner so that when the vise jaws are driven closed, the pins are depressed against the springs 62 which allows them to conform around the irregular work piece 65 while the springs 62 provide a gripping force that is proportional to the degree of displacement. Various spring and pin configurations can be used to provide lighter or heavier forces in order to accommodate a variety of work applications ranging from delicate to rugged.

In recapitulation, a vise accessory jaw having a unique means of mounting to a conventional vise, a set of accessory jaw brackets, front and rear, with special mounting provisions for each, capable of supporting and positioning a set of spring-loaded pin array accessory jaws with each pin configured to deflect individually and thereby capable of firmly and securely grasping a wide variety of irregularly shaped objects. The system is designed to accommodate a variety of accessory jaws, including, but not limited to, light, medium and heavy duty spring-pin array jaws suitable for grasping various work piece types ranging from delicate to rugged. Various spring-pin excursion lengths can also be provided, to accommodate more different shapes and different spring rate characteristics. The front accessory jaw bracket is secured by means of an axially driven adjustable wedge and the rear accessory jaw bracket is supported by a bolt that rests on the vise anvil. The front jaw face is secured in a stationary manner while the rear jaw face can be secured in a sliding manner, allowing for positional adjustment and securable either by means of a linear ratchet for ease of operation and continuous adjustment or alternatively using a series of evenly spaced pin holes in the jaw bracket. The ratchet teeth in conjunction with the pawl ensure that the initial load on the object is maintained. A simple arrangement such as a set of quick release pins can be used to mount the jaws. The jaw brackets may also be configured with flat finished jaw faces which thereby enable the vise to be used in the traditional manner without removing the brackets when the accessory jaws are not being used.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. A vise accessory intended to mount on a conventional vise without modification and provide the capability to grasp irregularly shaped objects, comprising:

a first accessory bracket for the stationary jaw mounted by means of both the threaded mounting holes provided in conventional vise jaw faces, as well as, a supporting beam of adjustable length extending downward from the rear of the first accessory bracket and resting on a rear portion of the vise and having a flat jaw face surface in front fashioned in such a way as to allow the first accessory bracket to be used as a conventional vise jaw face;

and a second accessory bracket for mounting on the movable jaw and mounted by means of both the threaded mounting holes provided in conventional vise jaw faces, as well as an underhung supporting wedge arrangement where the wedge is axially driven into the interstitial space between the movable jaw bracket and the vise by means of a screw so as to provide a secure fit and the capacity to withstand the forces generated by the clamping action of the vise thus configured and having a flat jaw face surface in front fashioned in such a way as to allow the second accessory bracket to be used as a conventional vise jaw face;

and a pair of accessory jaws mounted to the above brackets each consisting of a array of spring loaded pins protruding through a plate arranged and supported in a manner such that they can individually deflect and thereby form a grasping engagement of an irregularly shaped work piece when the vise jaws are closed.

2. The vise accessory of claim 1, wherein the two accessory jaws containing the spring loaded pin arrays are removable and interchangeable with a variety of similar accessory jaws having spring-loaded pin arrays with a range of performance characteristics as determined by such parameters as materials, spring strength, pin diameter, tip hardness, etc., suitable to various work situations.

3. The vise accessory of claim 1, wherein the rear jaw bracket, which mounts on the stationary jaw is configured to include a ratchet system that permits the rear accessory jaw to move relative to the jaw bracket and thus for its horizontal position to be continuously adjusted.

4. The vise accessory of claim 1, wherein the rear jaw bracket, which mounts on the stationary jaw is configured to include a series of pin holes that permits the jaw face to be positioned in a number of possible positions relative to the jaw bracket and thus for its horizontal position to be discretely adjusted.

5. The vise accessory of claim 1, with a series of accessory jaws including a flat jaw that can be used to grasp regular work pieces with an extended jaw capacity.

* * * * *